US007150077B2

(12) United States Patent
Hoover

(10) Patent No.: US 7,150,077 B2
(45) Date of Patent: Dec. 19, 2006

(54) APPARATUS AND METHOD FOR SPLICING SLIVER OF YARN DURING YARN FORMATION AND PROCESSING

(75) Inventor: Donald Lynn Hoover, Newton, NC (US)

(73) Assignee: American Linc Corporation, Gastonia, NC (US)

( * ) Notice: Subject to any disclaimer, the term of this patent is extended or adjusted under 35 U.S.C. 154(b) by 381 days.

(21) Appl. No.: 10/467,924

(22) PCT Filed: Jan. 15, 2002

(86) PCT No.: PCT/US02/01293

§ 371 (c)(1),
(2), (4) Date: Feb. 17, 2004

(87) PCT Pub. No.: WO02/064475

PCT Pub. Date: Aug. 22, 2002

(65) Prior Publication Data

US 2006/0150373 A1 Jul. 13, 2006

(51) Int. Cl.
*D01G 25/00* (2006.01)

(52) U.S. Cl. ..... 19/150; 19/157

(58) Field of Classification Search ..... 57/22, 57/23, 202, 261, 263; 19/144, 150, 157, 19/159 A, 159 R; 28/141, 254, 271, 272
See application file for complete search history.

(56) References Cited

U.S. PATENT DOCUMENTS

| | | | | |
|---|---|---|---|---|
| 2,608,725 | A * | 9/1952 | Strew | 19/157 |
| 3,308,520 | A | 3/1967 | Gagnon | |
| 3,633,352 | A * | 1/1972 | Marriner | 57/22 |
| 3,643,417 | A * | 2/1972 | Irwin | 57/202 |
| 3,654,755 | A * | 4/1972 | Bell | 57/23 |
| 4,018,039 | A * | 4/1977 | Leeper | 57/23 |
| 4,445,318 | A * | 5/1984 | Becker et al. | 57/22 |
| 4,457,128 | A * | 7/1984 | Brunvoll | 57/23 |
| 4,969,323 | A * | 11/1990 | Stahlecker | 57/261 |
| 4,982,563 | A * | 1/1991 | Stahlecker | 57/261 |
| 5,058,241 | A | 10/1991 | Haigh et al. | |
| 5,140,722 | A * | 8/1992 | Akiyama | 19/150 |
| 5,175,982 | A * | 1/1993 | Stahlecker | 57/22 |
| 5,357,740 | A * | 10/1994 | Moreland | 57/22 |

(Continued)

FOREIGN PATENT DOCUMENTS

| | | |
|---|---|---|
| JP | 62243836 | 4/1988 |

*Primary Examiner*—Gary L. Welch

(57) ABSTRACT

An apparatus (20) and methods are provided for splicing selected portions of sliver (S) such as during yarn formation and processing. The apparatus (20) preferably includes a needle carrying member (35) having a plurality of needles (32) to engage silver (S) when positioned adjacent thereto and a needle engaging member (45) positioned to underlie the needle carrying member (35) and to receive the plurality of needles (32) from the first needle carrying member (35). The apparatus (20) also preferably includes a hand-activated needle actuation device (30, 40) connected to the needle carrying member (35) and the needle engaging member (45) to position the needle carrying member (35) in an open position to allow sliver (S) to be spliced to be readily positioned therebetween and responsive to closing at least portions of the hand (H) of a user for actuating the engaging of the needle carrying member (35) with the sliver (S) and the needle engaging member (45) so that the engaging of plurality of needles (32) of the needle carrying member (35) with the needle engaging member (45) thereby defines a closed position.

17 Claims, 8 Drawing Sheets

U.S. PATENT DOCUMENTS 5,359,758 A * 11/1994 Stahlecker et al. ..... 28/117
5,483,730 A 1/1996 Hoover
5,488,758 A * 2/1996 Tahara et al. ..... 19/150
5,544,389 A * 8/1996 Onoue et al. ..... 19/157
5,551,134 A * 9/1996 Fehrer ..... 28/115
5,765,352 A * 6/1998 McRae ..... 57/22
6,065,191 A * 5/2000 Leifeld ..... 19/159 A
6,302,308 B1 10/2001 Hoover et al.
6,360,519 B1 3/2002 Hoover
6,415,971 B1 7/2002 Hoover et al.
6,481,072 B1 11/2002 Hoover et al.

* cited by examiner

20

50
30
32
32
50
43
40
42
45

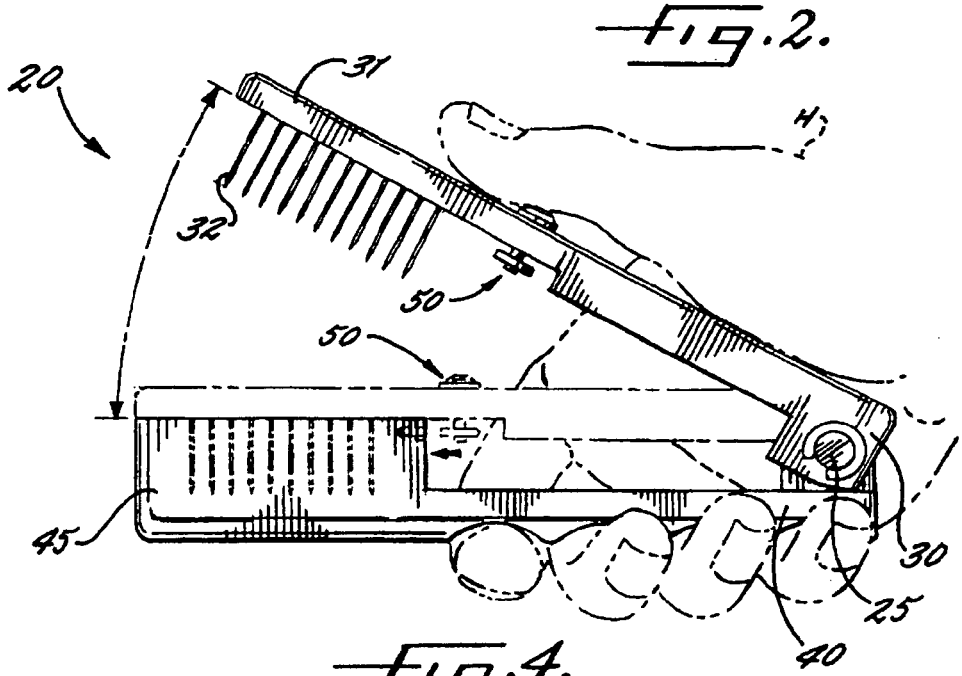
Fig. 2.
Fig. 4.
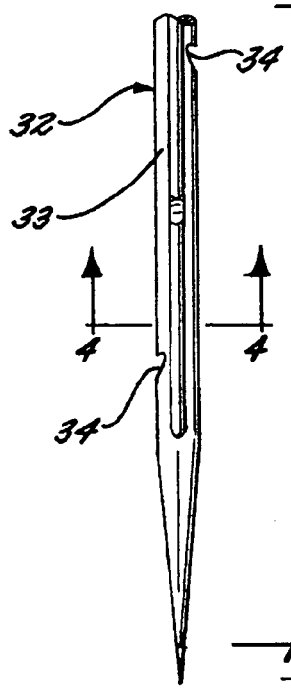
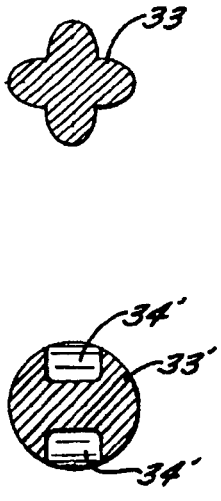
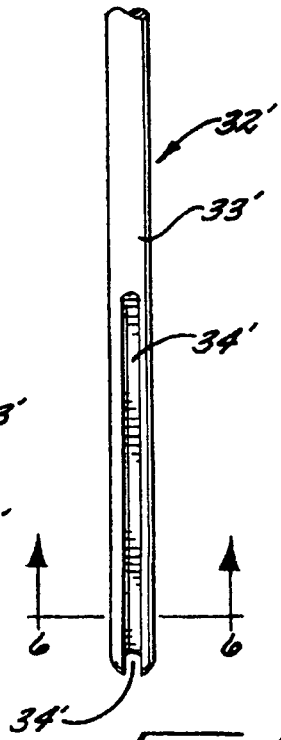
Fig. 6.
Fig. 3.
Fig. 5.

32
34
42
45
S
31

APPARATUS AND METHOD FOR SPLICING SLIVER OF YARN DURING YARN FORMATION AND PROCESSING

FIELD OF THE INVENTION

The present invention relates to the textile industry and, more particularly, to the field of textile splicing and methods.

BACKGROUND OF THE INVENTION

In the textile industry, yarn is formed of a plurality of slivers. To form the yarn, however, various steps are required to obtain the type and texture of the yarn desired. During sliver processing, sliver is often provided for shipment and use in cans or other containers which allow a first end of the sliver to be drawn or pulled from the can. A second end of the sliver is often left available for splicing to the first end of another can. This splicing is conventionally accomplished by a hand-type braid, twist, or other connection between the second end of the first can and the first end of the second can to join these respective ends of sliver together so that when the first can of sliver empties, the second can is ready to go for additional sliver processing. This hand-type braiding or twisting of the sliver has also become somewhat of a specialty of different textile personnel in sliver handling and processing. This manual procedure, however, can be time consuming, labor intensive, costly, inconsistent from person to person forming the braid or twist, and often is not strong or secure enough when the sliver is further handled or processed.

Other types of automatic splicing systems have been developed over the years. Examples can be seen in U.S. Pat. No. 5,544,389 by Onoue et al. titled "Sliver Piecing In Spinning Machines," U.S. Pat. No. 5,140,722 by Akiyama titled "Sliver Piecing Device Having Fiber Entangling Needles And Air Jets," U.S. Pat. No. 5,058,241 by Haigh et al. titled "Method And Apparatus For Combining Fibres Formed Into Slivers For Supply To Textile Machinery," U.S. Pat. No. 4,445,318 by Becker et al. titled "Method And Device For Making A Knot-Free Thread Connection By Splicing," U.S. Pat. Nos. 4,969,323 and 4,982,563 each by Stahlecker and each titled "Sliver Splicing Arrangement For A Spinning Machine," U.S. Pat. No. 2,608,725 by Strew titled "Sliver Piecing Device," U.S. Pat. No. 3,308,520 by Gagnon titled "Process Of Splicing Tow," U.S. Pat. No. 5,359,758 by Stahlecker et al. titled "Process And An Arrangement For The Piercing Of A Sliver," Japanese Patent Document Application No. 05105652 by Takashi titled "Sliver Joining Apparatus In Spinning Machine," and German Patent Document No. 90-210593/28 titled "Automatic Splicer For Roving On Ring-Spinning Frame—Has Needle Arrangement To Felt Fibres." These automated systems, however, can be quite expensive to install, can be costly to operate, can have various complex mechanical and/or electrical problems, can take up additional floor space in manufacturing environments, can be bulky and awkward to use, and can often require extensive special training for personnel or the hiring of special personnel to oversee this automated equipment.

SUMMARY OF THE INVENTION

Although somewhat manually operated splicers have also been developed as shown in U.S. Pat. No. 5,058,241 by Haigh et al. titled "Method And Apparatus For Combining Fibres Formed Into Slivers For Supply To Textile Machinery" and in JP 62 243836 A by Hiroshi titled "Joining Of Stringy And Fibrous Assembly." Applicant has also recognized that these manually operated splicers can be difficult to insert and withdraw fiber from adjacent needles of the splicer thereby inhibiting desire to be used, can require special inserting of the fiber into a sliver mounting region to accomplish a splice and thereby make it difficult to use, restricts quantities or amounts of fiber that can be positioned in the sliver mounting region, and can include a structure that may increase the risk of damage to a user's hands when using or carrying such a device.

With the foregoing in mind, the present invention advantageously provides an apparatus and methods for splicing slivers of yarn during formation and processing which is compact, relatively simple to use, and readily portable. The present invention also advantageously provides an apparatus and methods for splicing various types of textile slivers which is relatively inexpensive and does not require extensive personnel training to understand and operate. The present invention additionally advantageously provides an apparatus and methods for splicing various types of textile sliver which allows the user to easily handle, carry, and tote and which is of such a size as to be easily inserted into a pocket of a garment or a carrying case worn by the user. The present invention still also advantageously provides an apparatus and methods for splicing textile sliver which forms a substantially secure connection between ends of sliver being spliced or joined for later handling and/or processing. The present invention further advantageously provides an apparatus and methods for splicing textile sliver which is less complex, easy to repair or replace parts, and is readily adaptable to various splicing needs and situations.

More particularly, the present invention provides an apparatus for splicing selected portions of sliver which preferably includes a needle carrying member having a plurality of needles to engage sliver when positioned adjacent thereto, a needle engaging member positioned to receive the plurality of needles from the first needle carrying member when the plurality of needles engage the sliver in a closed position, and a hand-activated needle actuation device connected to the needle carrying member and the needle engaging member to position the needle carrying member in an open position so that the plurality of needles is spaced-apart from the needle engaging member to allow sliver to be spliced to be readily positioned therebetween and responsive to grippingly closing at least portions of the hand of a user to actuate the engaging of the needle carrying member with the sliver and the needle engaging member when the sliver is positioned between the needle carrying member and the needle engaging member so that the engaging of plurality of needles of the needle carrying member with the needle engaging member thereby defines a closed position.

The present invention also advantageously provides an apparatus for splicing sliver which preferably includes a first handle portion having at least one sliver engaging member, a second handle portion positioned to receive the at least one sliver engaging member in a closed position, and a pivot member associated with the first and second handle portions to allow either the first or second handle portions to pivot about the pivot member between respective open and closed positions. The open position preferably is defined by portions of the first handle member having the at least one sliver engaging member being spaced-apart from portions of the second handle portion positioned to receive the at least one sliver engaging member, and the closed position preferably is defined by the at least one sliver engaging member of the first handle portion being received by the portions of the second handle member when positioned closely adjacent thereto. The apparatus preferably further includes a biasing member associated with the pivot member and positioned to bias either the first or the second handle portions in a preselected biased position.

The present invention additionally provides an apparatus for splicing sliver which preferably includes a first handle portion having a first handle body and at least one sliver engaging member detachably connected to the first handle body to thereby define a cartridge member, a second handle portion pivotally connected to and positioned to receive the at least one sliver engaging member and pivot between open and closed positions. The open position is preferably defined by the at least one sliver engaging member being spaced-apart from portions of the second handle portion positioned to receive the at least one sliver engaging member, and the closed position preferably is defined by the at least one sliver engaging member of the first handle portion being received by the portions of the second handle member when positioned closely adjacent thereto. The apparatus preferably also includes a biasing member positioned to bias either the first or the second handle portions in a preselected biased position.

The present invention further provides methods of splicing sliver. A first method preferably includes grippingly closing a handle portion of a sliver splicer having at least one sliver engaging member by the hand of a user so that the at least one sliver engaging member engages and splices sliver positioned adjacent thereto and releasingly opening the handle portion by the hand of the user to thereby release the spliced portion of sliver from the at least one sliver engaging member.

Another method of splicing sliver, according to the present invention, preferably includes closing a handle portion of a needle engaging member having a plurality of needles so that the plurality of needles engages and splices sliver positioned adjacent thereto and opening the handle portion of the needle engaging member so that the plurality of needles release the spliced portions of sliver therefrom.

Yet another method of splicing sliver according to the present invention preferably includes joining first portions of sliver with a plurality of needles each having a recessed portion to engage and intertwine with adjacent second portions of sliver, the plurality of needles being connected to a body portion so that the body portion and the plurality of needles in combination define a needle cartridge member and replacing the needle cartridge member with an auxiliary cartridge member also having a body portion and a plurality of needles connected to the body portion.

The apparatus and methods of the present invention provide additional manufacturing, handling, processing, and formation flexibility in the use of the splicers for sliver. For example, manufacturing personnel can walk around a facility with an apparatus of the present invention positioned in a pocket, holster, or harness when the splicing apparatus or splicer is preferably in a locked closed position so that the manufacturing personnel can readily remove the splicer, unlock the splicer, accomplish the splicing function, relock the splicer, and return the splicer to the pocket, holster, or harness. Additionally, the splicing apparatus of the present invention can be strapped to a chain or belt which can enhance carrying and portability. Further, when one or more needles or other sliver engaging members are damaged, according to one embodiment of the present invention, a cartridge member can readily be removed which carries the needles and replaced with an auxiliary cartridge member. This cartridge replacement, for example, prevents the need to replace the entire splicing apparatus and saves money and reordering time. Also, because the splicing apparatus is portable, compact, and relatively of simple construction and low cost, many different types of manufacturing personnel can use the splicing apparatus and can readily order additional or readily replace the entire splicing apparatus if desired without incurring extensive costs.

BRIEF DESCRIPTION OF THE DRAWINGS

Some of the features, advantages, and benefits of the present invention having been stated, others will become apparent as the description proceeds when taken in conjunction with the accompanying drawings in which:

FIG. 2 is a side elevational view of an apparatus for splicing sliver being actuated by the hand of a user according to a first embodiment of the present invention;

FIG. 3 is an enlarged fragmentary elevational view of a type of needle of an apparatus for splicing sliver according to the present invention;

FIG. 4 is a sectional view of a needle of an apparatus for splicing sliver taken along line 4—4 of FIG. 3 according to the present invention;

FIG. 5 is an enlarged fragmentary elevational view of a needle of an apparatus for splicing sliver according to the present invention;

FIG. 6 is a sectional view of a needle of an apparatus for splicing sliver taken along line 6—6 of FIG. 5 according to the present invention;

DETAILED DESCRIPTION OF PREFERRED EMBODIMENTS

Figure 1:
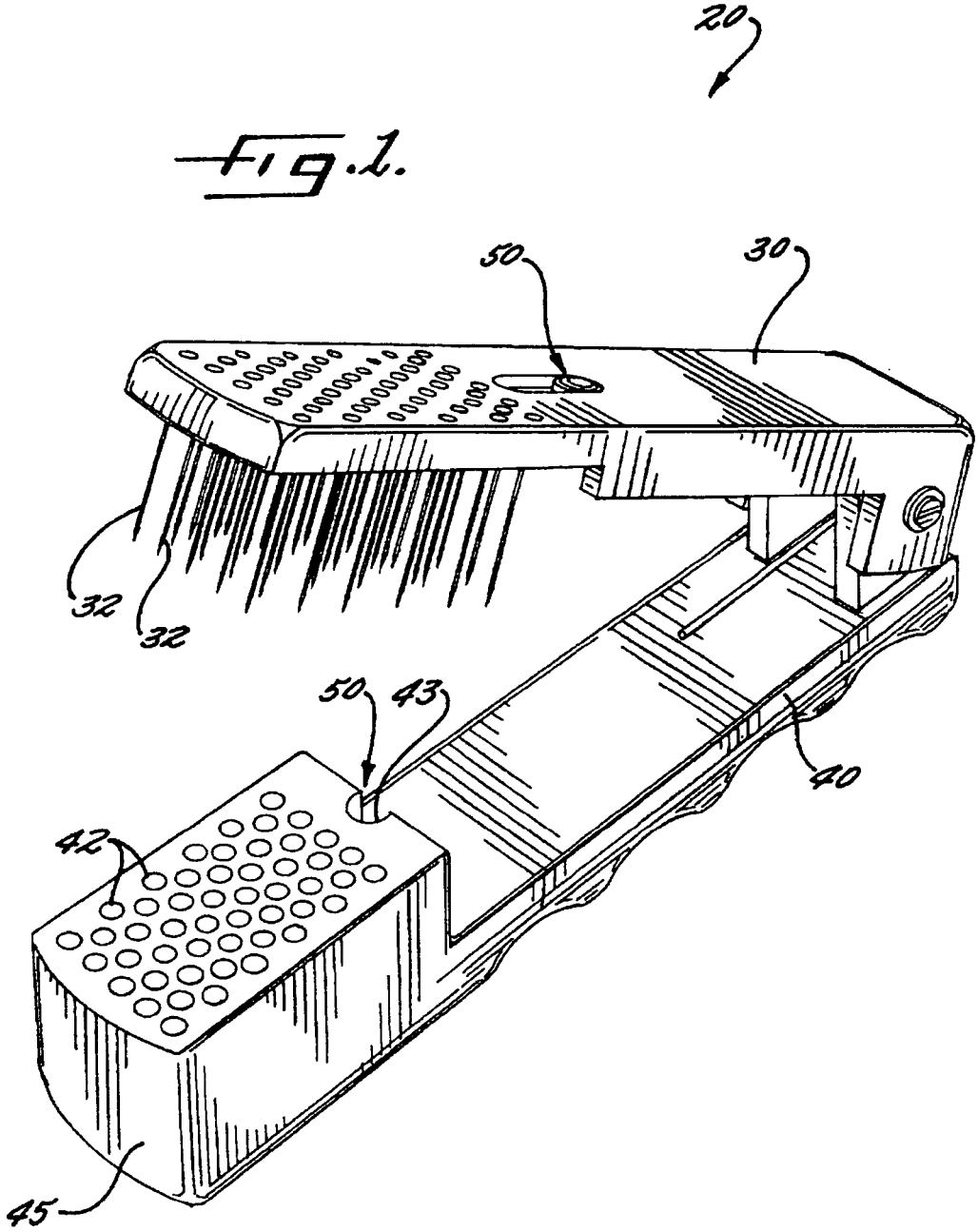
FIG. 1 is a perspective view of an apparatus for splicing sliver according to a first embodiment of the present invention.
Figure 7A:
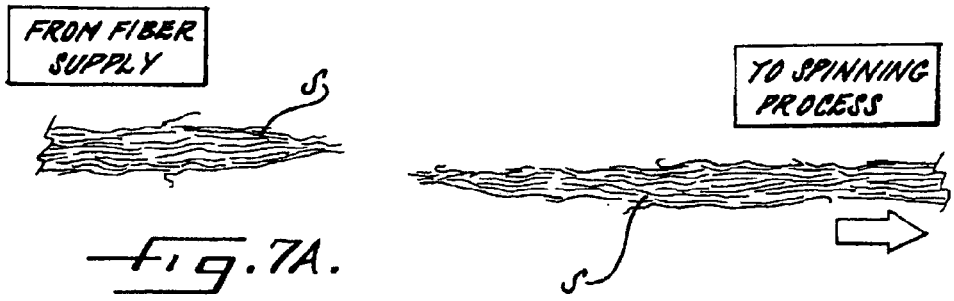
FIGS. 7A–7D are schematic perspective views of the operation of an apparatus for splicing sliver according to a first embodiment of the present invention.
Figure 7B:
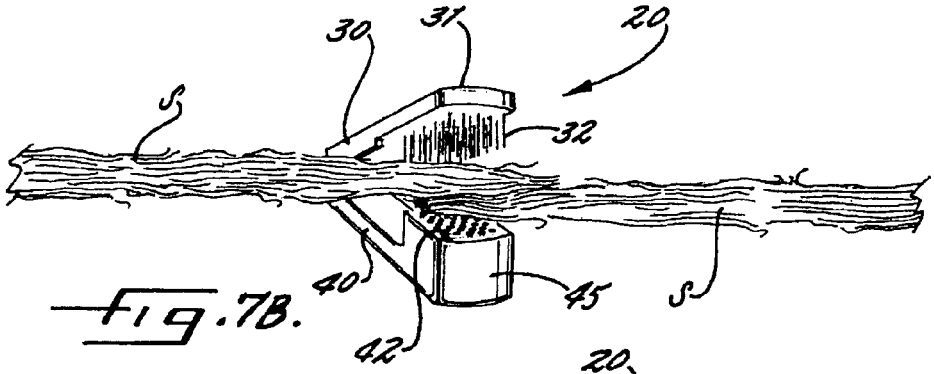
Figure 7C:
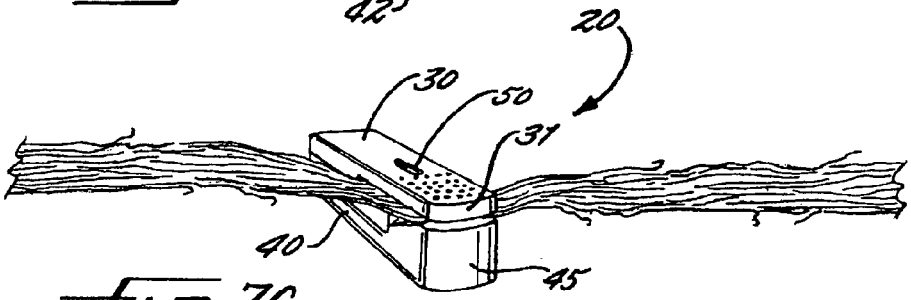
Figure 7D:
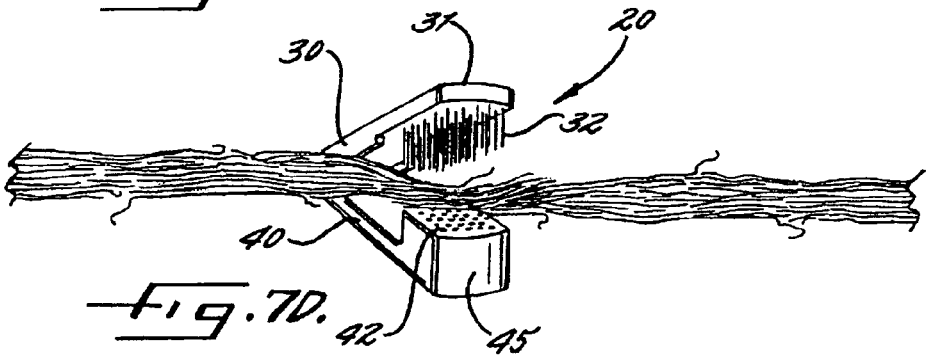
Figures 8A, 8B:
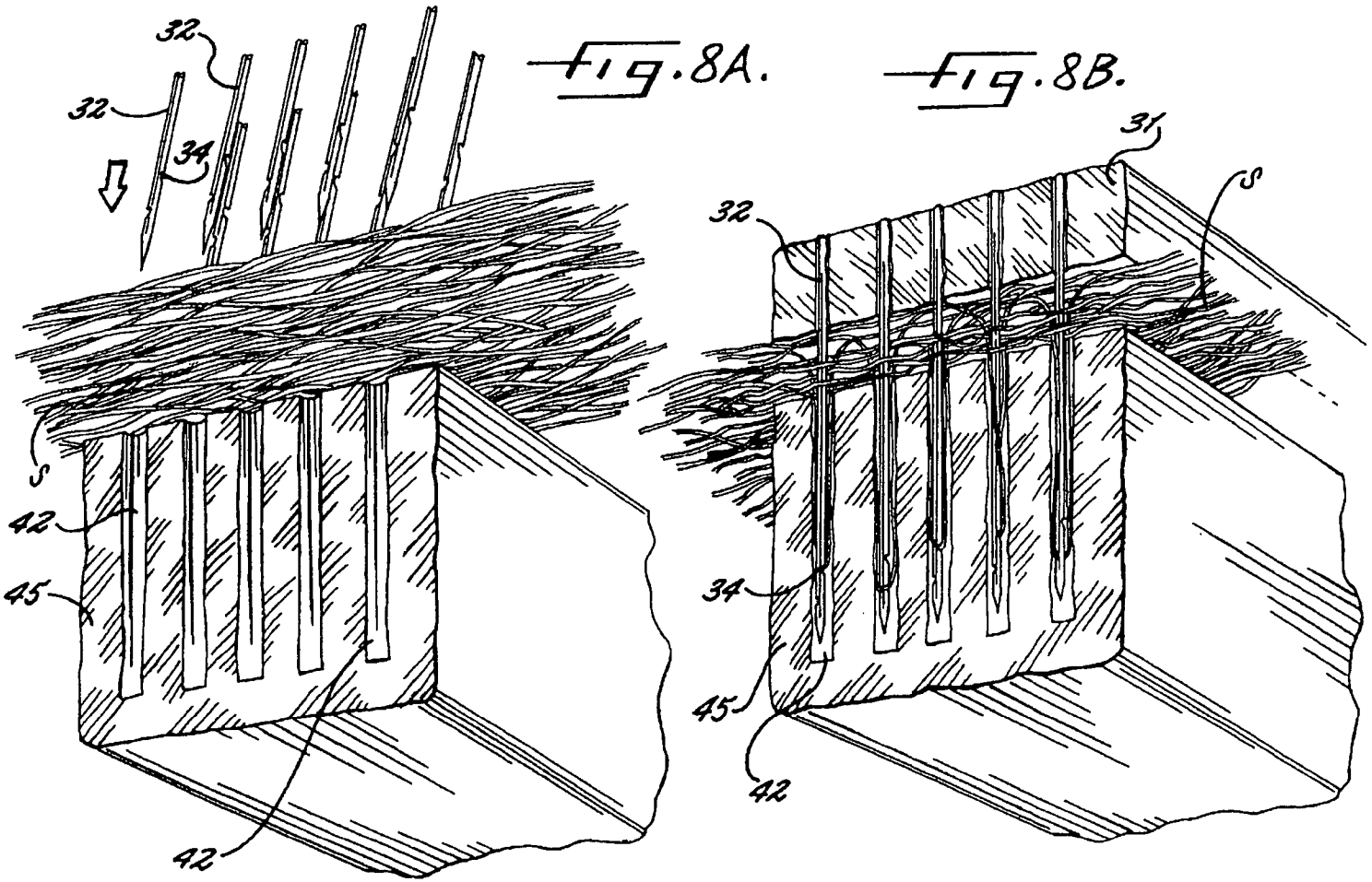
FIG. 8A is an enlarged fragmentary perspective view of an apparatus for splicing sliver prior to engagement with sliver in an open position according to the present invention.
FIG. 8B is an enlarged fragmentary perspective view of an apparatus for splicing sliver after engagement with the sliver in a closed position according to the present invention.
Figure 9:
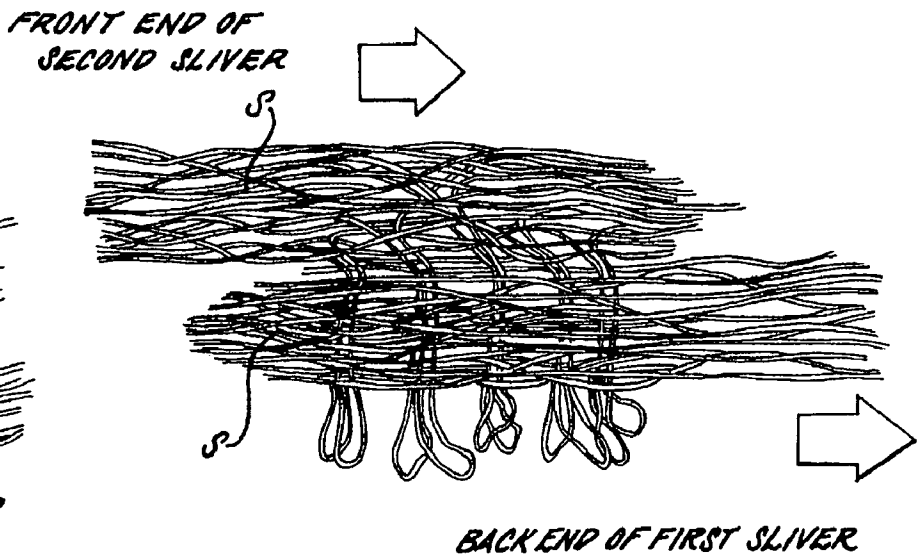
FIG. 9 is an enlarged fragmentary view of sliver after being spliced with an apparatus for splicing sliver according to the present invention.
Figure 8C:
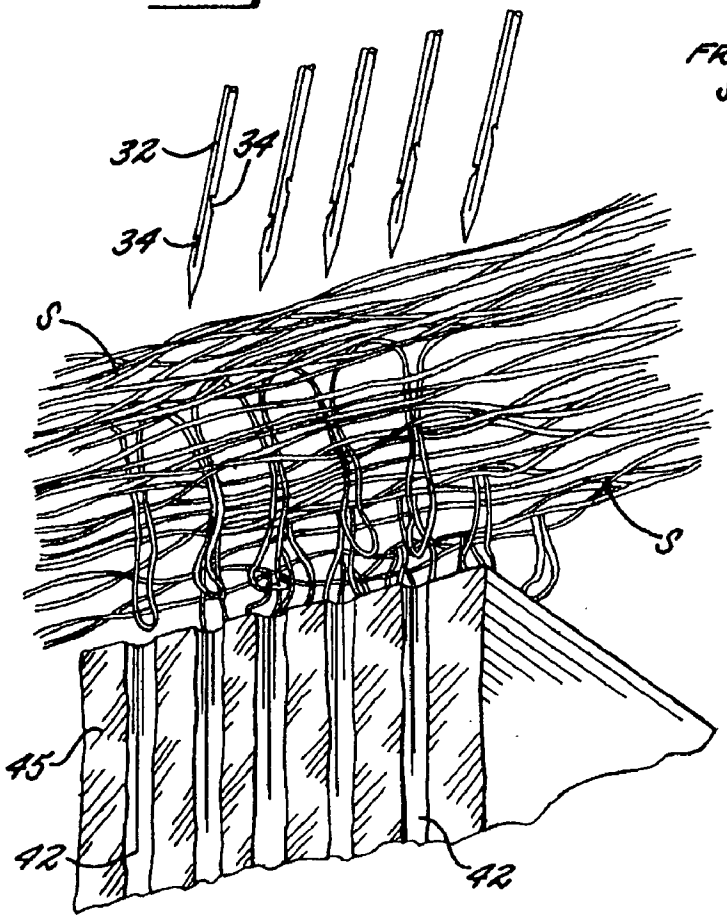
FIG. 8C is an enlarged fragmentary perspective view of an apparatus for splicing sliver after engagement with the sliver in an open position according to the present invention.

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime notation, if used, indicates similar elements in alternative embodiments.

FIGS. 1–9 illustrate a first embodiment of an apparatus 20 for splicing sliver S. The apparatus 20 preferably includes a first handle portion 30 having at least one sliver engaging member. The at least one sliver engaging member is preferably one or more needles 32, and more preferably a plurality of needles 32, connected to the first handle portion 30. A second handle portion 40 preferably is positioned to receive the at least one sliver engaging member, e.g., the plurality of needles 32, in a closed position such as through or within one or more openings or bores 42, 42' as shown (see also FIG. 10). As perhaps be shown in FIGS. 1–2 and 14, a pivot member 25 is associated with, and preferably connected to or mounted as illustrated, to the first and second handle portions 30, 40 to allow either the first or second handle portions 30, 40 to pivot about the pivot member 25 between respective open and closed positions. The open position preferably is defined by distal portions 31 of the first handle portion 30 having the at least one sliver engaging member being spaced-apart from distal portions 31 of the second handle portion 40 positioned to receive the at least one sliver engaging member, and the closed position preferably is defined by the at least one sliver engaging member of the first handle portion 30 being received by the distal portions of the second handle portion 40 when positioned closely adjacent thereto. The first and second handle portions 30, 40 can advantageously defined a base which is advantageously hand operated, but other base structures as understood by those skilled in the art which may or may not be hand operated can be used as well according to the present invention.

Figures 10, 11:
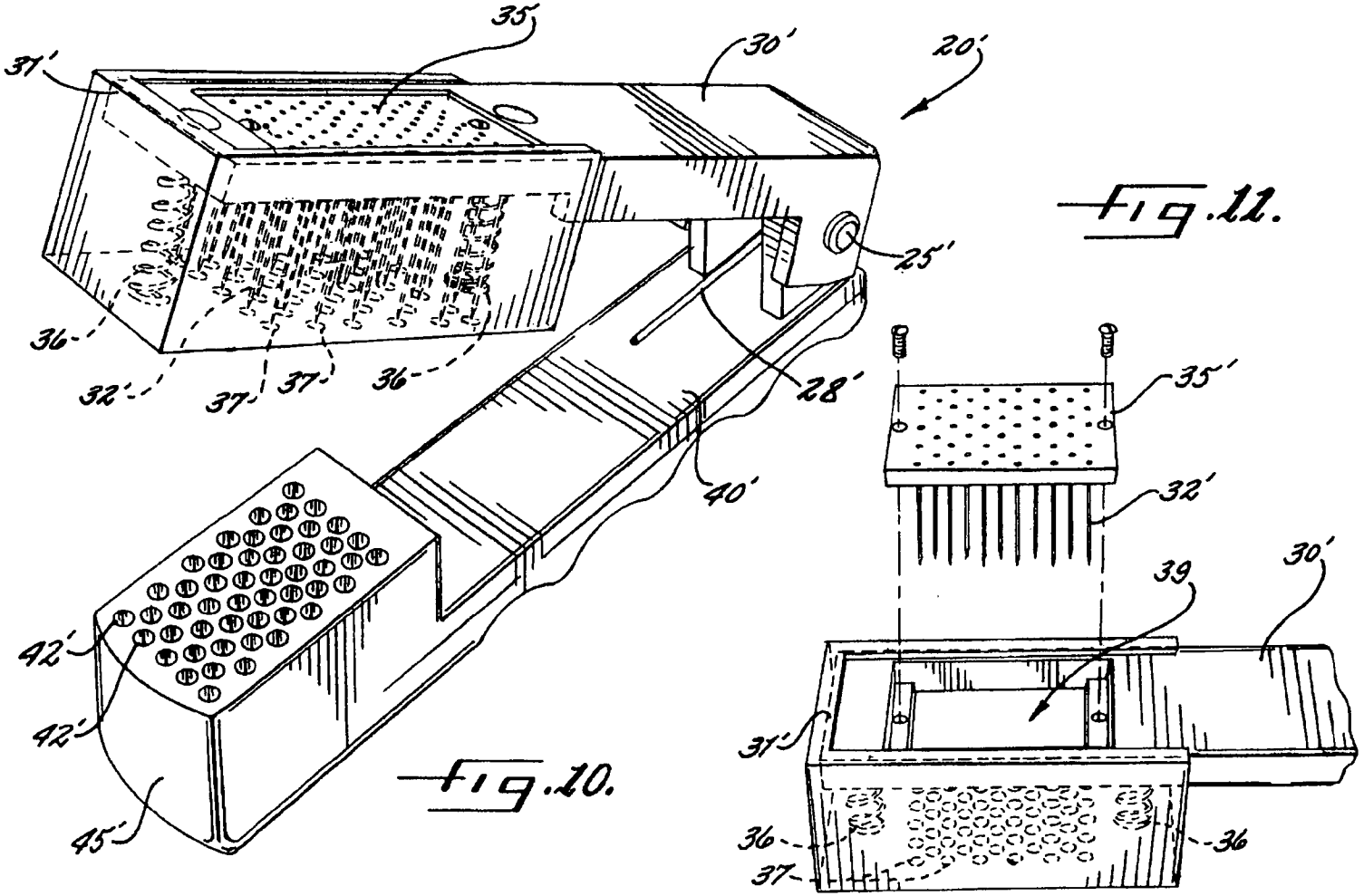
FIG. 10 is a perspective view of an apparatus for splicing sliver according to a second embodiment of the present invention.
FIG. 11 is an exploded fragmentary perspective, view of a needle cartridge for positioning in an apparatus for splicing sliver according to a second embodiment of the present invention.
Figure 12:
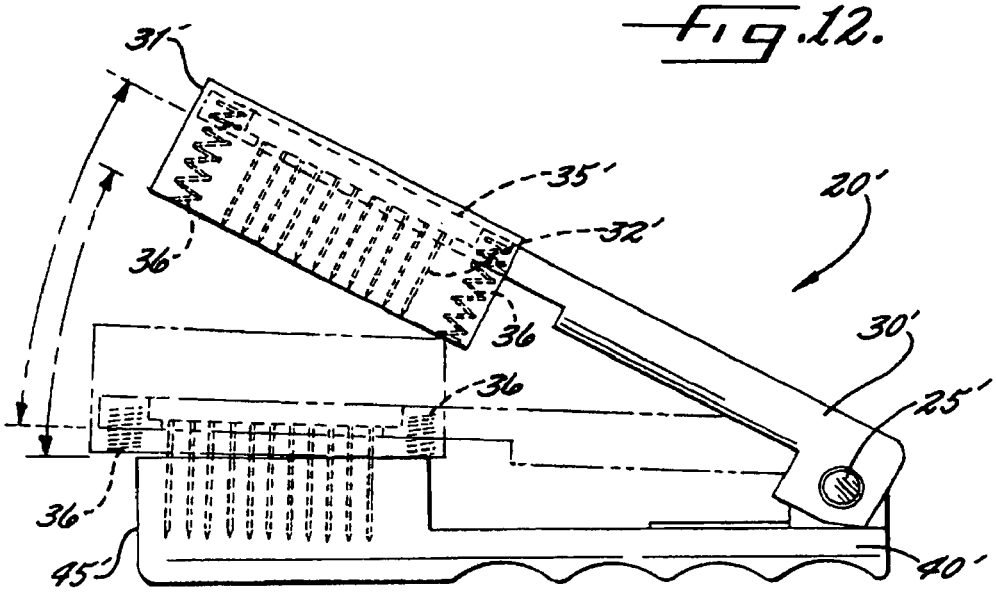
FIG. 12 is a side elevational view of an apparatus for splicing sliver having a needle cartridge illustrated by broken lines for clarity according to a second embodiment of the present invention.
Figure 13:
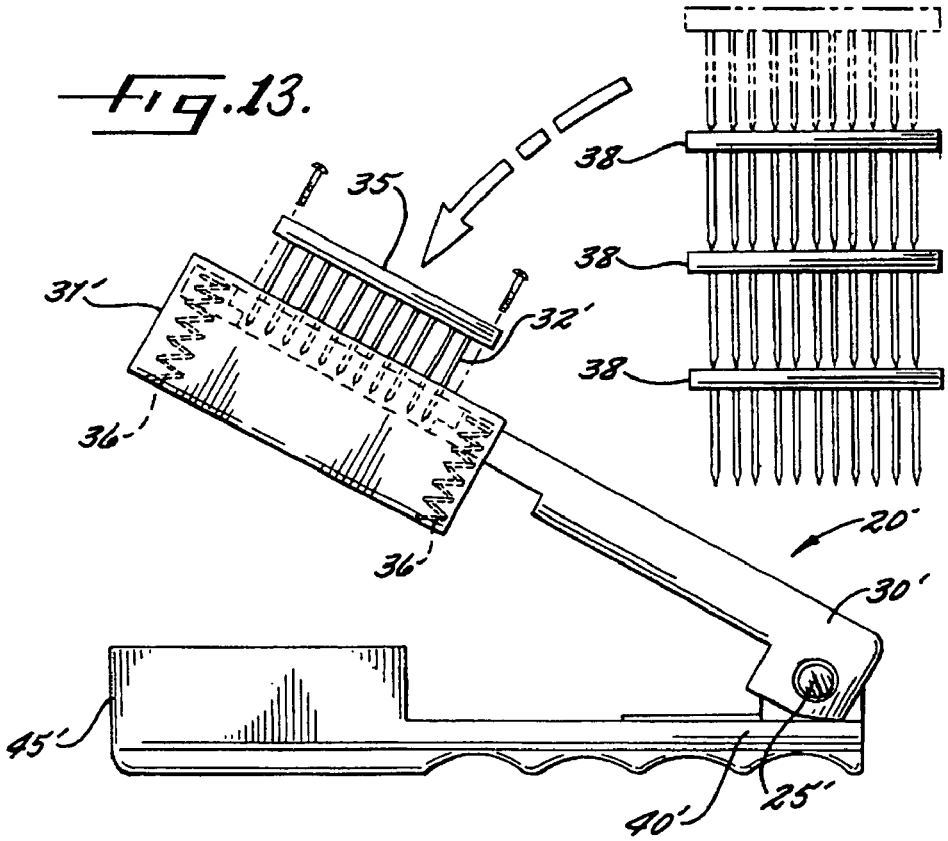
FIG. 13 is an exploded side elevational view of an apparatus for splicing sliver having a needle cartridge member and a plurality of replacement auxiliary needle cartridge members according to a second embodiment of the present invention.
Figure 14:
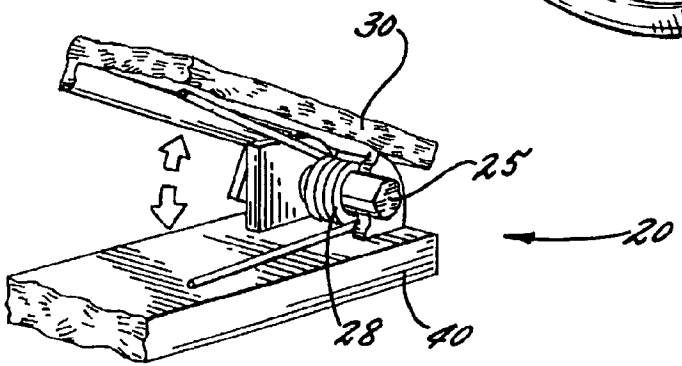
FIG. 14 is a fragmentary perspective view a portion of an apparatus for splicing sliver illustrating a connection between first and second handle portions along a pivot member and the position of a biasing member to bias the apparatus in an open position according to the present invention.

The apparatus 20 preferably includes a biasing member 28, 28' associated with the pivot member 25, 25' and positioned to bias either the first or the second handle portions 30, 40 in a preselected biased position (see also FIGS. 10 and 12–13). In the embodiment of the splicing apparatus 20 as illustrated, the first handle portion 30 is biased by the biasing member 28 to the open position. As shown in FIG. 14, the biasing member 28 is preferably a spring as understood by those skilled in the art and preferably is connected to the pivot member 25 and positioned to bias the first handle portion 30 in the open position. Other types of biasing members, including various types of springs, can be used as well. Although the illustrated embodiment of biasing the first handle portion 30 in the open position is particularly advantageous due to the movement desired in the splicing process and the ease of use by a user's hand, for example, it will also be understood by those skilled in the art that the present invention would include biasing the splicing apparatus 20" in the closed position (see also FIG. 15). Further, the apparatus 20 preferably also includes a lock 50 associated with the first and second handle portions 30, 40 to lock the first and second handle portions 30, 40 in a closed position. In the embodiment shown, the lock 50 is primarily connected to the first handle portion 30 and slidably engages or locks, e.g., a latch, with the second handle portion 40, e.g., into a slot or channel 43 by connecting to the needle receiving portion or body 45 of the second handle portion 40 (see FIG. 2).

As perhaps best illustrated in FIG. 2, the first and second handle portions 30, 40 define a hand-activated needle actuation device which advantageously allows a ready grip by a user's hand H to apply pressure from the user's hand H to actuate the movement of the plurality of needles 32. As described above, and as illustrated in FIGS. 7A–7D and 8A–8C, the at least one sliver engaging member preferably includes a plurality of needles 32, and the hand-activated needle actuation device is responsive to grippingly closing at least portions of the hand H of a user to actuate the engaging of the plurality of needles 32 with the sliver S to be spliced and the distal portions 45, e.g., through the openings or bores 42, 42' of the second handle portion 40 when the sliver S is positioned between the plurality of needles 32 and the distal portions 45 of the second handle portion 40 so that the engaging of plurality of needles 32 with the distal portions 45 of the second handle portion 40 thereby further defines the closed position (see also FIG. 10).

Also, as perhaps best shown in FIGS. 3–6 and 8A–8C, each of the plurality of needles 32 preferably includes a needle body 33, 33' and a recessed portion 34, 34' formed in the needle body 33, 33' and positioned to assist in the engaging of and interconnecting of the sliver S when each needle 32, 32' engages sliver S during movement to the closed position. The recessed portion 34, 34' preferably includes at least one of the following: a barb, a groove, and a channel. The recessed portion 34, 34' preferably has an upward slope with respect to the downward movement of the needle 32 so that the recessed portion 34, 34' readily catches, engages, or otherwise contacts the sliver S during the downward motion of the needles and responsively releases the sliver S during upward motion. This process allows the intertwining or interconnecting of the sliver S to join the portions of sliver S desired to be spliced together.

As shown in FIGS. 10–13 and 15, according to a second embodiment of a splicing apparatus 20' of the present invention, the at least one sliver engaging member preferably is detachably connected to the first handle portion 30' and defines a cartridge member 35, 35' positioned in distal portions 31' of the first handle portion 30' to readily remove from the first handle portion 30'. At least one replacement auxiliary cartridge member 38, and preferably a plurality of replacement auxiliary cartridge members 38, can have the same construction as the cartridge member 35, 35' and can be adapted to be readily positioned in the first handle portion 30'. Accordingly, a kit can also be provided which has a portable splicing apparatus 20' positioned in a container, e.g., box, bag, package, with one or more auxiliary cartridge members 38, so that when a cartridge member 35, 35' being used is damaged, dulled, or otherwise desired to be replaced, another cartridge member 38 can be readily inserted into an opening 39 in the first handle portion 30' of the splicing apparatus 20' after removal of the damaged cartridge member 35, 35' so that splicing operations proceed with substantially reduced interruptions. The distal portion 31' of the first handle portion 30' preferably has additional springs or other types of biasing members 36 which allow the needles 32' to retract and extend from openings 37 in the distal portion 31' as shown.

Figure 15:
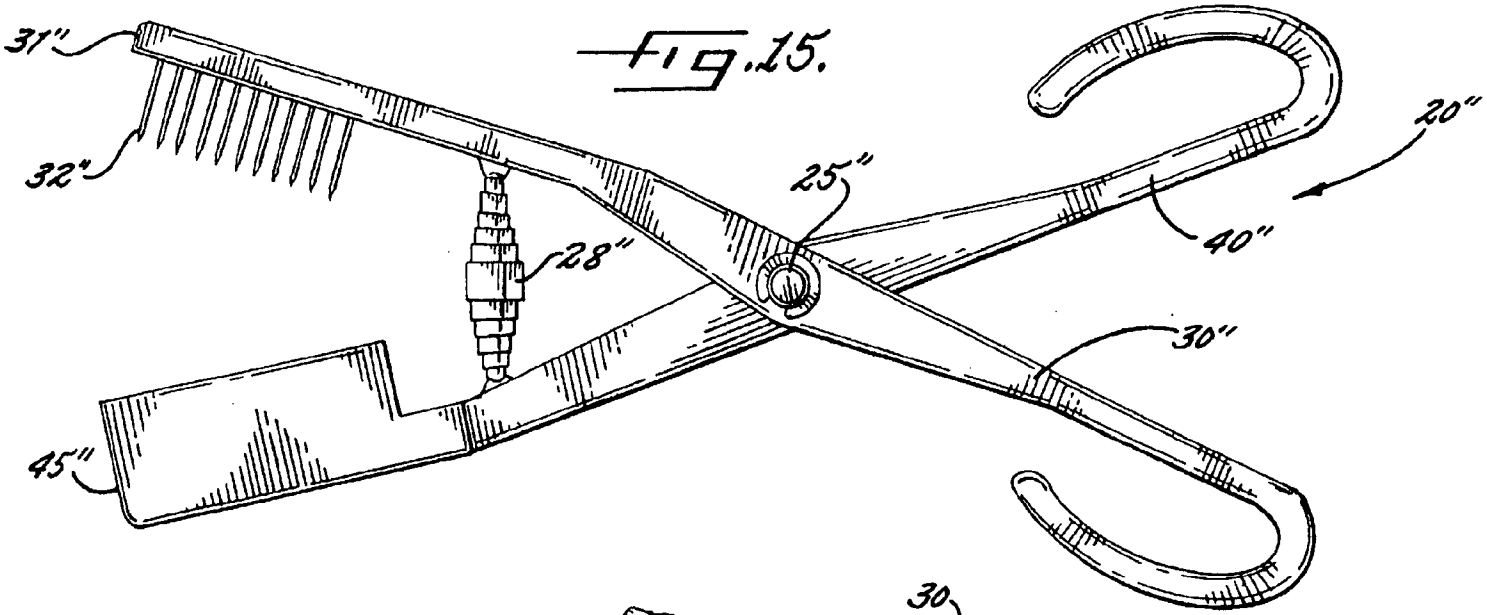
FIG. 15 is an apparatus for splicing sliver according to a third embodiment of the present invention.

Further still, as shown in FIG. 15, scissor-type handles 30", 40", substantially closed loops, and various other types of handle or finger grips can also be used. In this embodiment of a splicing apparatus 20", the pivot member 25" is also moved forward toward a more medial portion of the handle members 30", 40" and the biasing member 28" is another type of spring, as understood by those skilled in the art, which biases the scissor-type handle embodiment to a closed position so that the distal portions 31", 45" of the handles are positioned closely adjacent each other and the plurality of needles 32" can engage receiving portions of the handle 40".

As illustrated in FIGS. 1–15, the present invention further provides methods of splicing sliver S. A first method preferably includes grippingly closing a handle portion 30 of a sliver splicer 20 having at least one sliver engaging member 32 by the hand H of a user so that the at least one sliver engaging member 32 engages and splices sliver S positioned adjacent thereto and releasingly opening the handle portion 30 by the hand H of the user to thereby release the spliced portion of sliver S from the at least one sliver engaging member 32.

Another method of splicing sliver S according to the present invention preferably includes closing a handle portion 30 of a needle engaging member having a plurality of needles 32 so that the plurality of needles 32 engages and splices sliver S positioned adjacent thereto and opening the handle portion 30 of the needle engaging member so that the plurality of needles 32 release the spliced portions of sliver S therefrom.

Yet another method of splicing sliver S according to the present invention preferably includes joining first portions of sliver S with a plurality of needles 32 each having a recessed portion 34 to engage and intertwine with adjacent second portions of sliver S. The plurality of needles preferably is connected to a body portion so that the body portion and the plurality of needles 32 in combination define a needle cartridge member 35 and replacing the needle cartridge member 35 with an auxiliary cartridge member 38 also having a body portion and a plurality of needles 32 connected to the body portion.

The apparatus 20, 20', 20" and methods of the present invention provide additional manufacturing, handling, processing, and formation flexibility in the use of the splicers for sliver. For example, manufacturing personnel can walk around a facility with an apparatus 20 of the present invention positioned in a pocket, holster, or harness when the splicing apparatus 20 or splicer is preferably in a locked closed position so that the manufacturing personnel can readily remove the splicer 20, unlock the splicer 20, accomplish the splicing function, relock the splicer 20, and return the splicer 20 to the pocket, holster, or harness. Additionally, the splicing apparatus 20 of the present invention can be strapped to a chain or belt which can enhance carrying and portability. Further, when one or more needles 32 or other sliver engaging members are damaged, according to one embodiment of the present invention, a cartridge member 35 can readily be removed which carries the needles 32' and replaced with an auxiliary cartridge member 38. This cartridge replacement, for example, prevents the need to replace the entire splicing apparatus 20' and saves money and reordering time. Also, because the splicing apparatus 20 is portable, compact, and relatively of simple construction and low cost, many different types of manufacturing personnel can use the splicing apparatus 20, 20', 20" and can readily order additional or readily replace the entire splicing apparatus 20, 20', 20" if desired without incurring extensive costs.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That claimed is:

1. An apparatus for splicing selected portions of sliver, the apparatus comprising:

a needle carrying member having a plurality of needles to engage sliver when positioned adjacent thereto;

a needle engaging member positioned to receive the plurality of needles from the needle carrying member when the plurality of needles engage the sliver in a closed position; and a hand-activated needle actuation device connected to the needle carrying member and the needle engaging member to position the needle carrying member in an open position so that the plurality of needles is spaced-apart from the needle engaging member to allow sliver to be spliced to be readily positioned therebetween, the hand-activated needle actuation device being responsive to grippingly closing at least portions of a hand of a user to actuate the engaging of the needle carrying member with the sliver and the needle engaging member when the sliver is positioned between the needle carrying member and the needle engaging member so that the engaging of the plurality of needles of the needle carrying member with the needle engaging member thereby defines a closed position; and wherein the hand-activated needle actuation device includes a first handle portion connected to the needle carrying member and positioned to be gripped by a hand of a user, a second handle portion connected to the needle engaging member and positioned to be gripped by a hand of a user, a pivot member connected to the first and second handle portions to allow either the first or second handle portions to pivot about the pivot member between the respective open and closed positions, and a biasing member associated with the first and second handle portions and positioned to bias the needle carrying member in the closed position.

2. An apparatus as defined in claim 1, wherein the needle engaging member includes a body member and a plurality of openings formed in the body member and each extending to a depth in the body member so that none of the plurality of needles extend outwardly from the needle engaging member when in the closed position, the number of the plurality of openings being equal to the number of the plurality of needles, each of the plurality of openings being positioned to underlie a corresponding one of the plurality of needles of the needles carrying member so that the plurality of openings matingly receive the plurality of needles as the plurality of needles pass into and out of the plurality of openings to thereby engage the needles and sliver being carried therewith.

3. An apparatus as defined in claim 2, wherein the body member of the needle engaging member includes a substantially closed bottom, and wherein the bottom underlies each of the plurality of openings so that portions of the bottom define a floor for each of the plurality of openings.

4. An apparatus as defined in claim 1, further comprising a lock associated with the hand activated needle actuation device to lock the hand activated needle actuation device in the closed position so that none of the plurality of needles extend outwardly from the needle engaging member when locked in the closed position.

5. An apparatus as defined in claim 1, wherein each of the plurality of needles includes a needle body and a recessed portion formed in the needle body and positioned to assist in the engaging of and interconnecting of the sliver when each needle engages sliver during movement to the closed position.

6. An apparatus as defined in claim 1, wherein the needle carrying member is detachably connected to at least one of the first handle portion and the second handle portion and defines a needle cartridge to readily remove from the respective first handle portion and second handle portion.

7. An apparatus as defined in claim 6, further comprising at least one replacement auxiliary needle cartridge adapted to be readily positioned in the at least one of the first handle portion and the second handle portion.

8. An apparatus for splicing sliver, the apparatus comprising a base and a needle receiving member associated with the base and positioned to receive a plurality of needles, the apparatus being characterized by having:

a first cartridge member detachably connected to the base to be readily removed therefrom, the first cartridge member having a combination of a body portion and a plurality of needles each connected to the body portion, each of the plurality of needles having a recessed portion to engage and intertwine first portions of sliver with adjacent second portions of sliver; and a second auxiliary replacement cartridge member adapted to be detachably connected to the base and to be placed in substantially the same position as the first cartridge member, the second auxiliary replacement cartridge member also having a combination of a body portion and a plurality of needles each connected to the body portion and adapted to be positioned to be received by the needle receiving member, each of the plurality of needles having a recessed portion to engage and intertwine first portions of sliver with adjacent second portions of sliver.

9. An apparatus as defined in claim 8, further comprising a pivot member associated with the first cartridge member and the needle receiving member to allow either the first cartridge member or needle receiving member to pivot about the pivot member between respective open and closed positions, the open position being defined by portions of the first cartridge member being spaced-apart from portions of the needle receiving member to receive the first cartridge member and the closed position being defined by the first cartridge member being received by portions of the needle receiving member when positioned closely adjacent thereto.

10. An apparatus as defined in claim 9, further comprising a biasing member associated with the pivot member and positioned to bias either the first cartridge member or the needle receiving member in a preselected biased position.

11. An apparatus as defined in claim 8, wherein the recessed portion of each of the plurality of needles of the first and second cartridge members includes at least one of the following: a barb, a groove, and a channel.

12. An apparatus as defined in claim 8, a lock associated with the first cartridge member and the needle receiving member to lock the first cartridge member and the needle receiving member in a closed position.

13. A method of splicing sliver, the method being characterized by the steps of:

grippingly closing a first handle portion and a second handle portion of a sliver splicer having at least one sliver engaging member by a hand of a user so that the at least one sliver engaging member engages and splices sliver positioned adjacent thereto when in a closed position, the at least one sliver engaging member having a plurality of needles each including a recessed portion to engage and intertwine first portions of the sliver with second portions of the sliver to thereby join the first portions to the second portions of the sliver;

releasingly opening the first handle portion and the second handle portion by the hand of the user from the closed position to an open position to thereby release the spliced portion of sliver from the at least one sliver engaging member; and removing the spliced portion from adjacent the at least one sliver engaging member;

grippingly closing the first handle portion and the second handle portion to the closed position without sliver positioned therebetween; and locking the first handle portion and the second handle portion in the closed position.

14. A method as defined in claim 13, further comprising removing the spliced portion from adjacent the at least one sliver engaging member and biasingly closing the first handle portion and the second handle portion to the closed position without sliver positioned therebetween.

15. A method as defined in claim 14, wherein none of the recessed portion of each of the plurality of needles is exposed when in the closed position.

16. A method of splicing sliver comprising joining first portions of sliver with a plurality of needles having a recessed portion to engage and intertwine with adjacent second portions of sliver, the method characterized by having:

the plurality of needles being connected to a body portion so that the body portion and the plurality of needles in the combination define a needle cartridge member; and replacing the needle cartridge member with an auxiliary cartridge member also having a body portion and a plurality of needles connected to the body portion.

17. A method as defined in claim 16, wherein each of the plurality of needles includes a needle body, and wherein the recessed portion is formed in the needle body and positioned to assist in the engaging of and interconnecting of the sliver when each needle engages sliver.

* * * * *